US005387158A

United States Patent [19]

Bertrand

[11] Patent Number: 5,387,158

[45] Date of Patent: Feb. 7, 1995

[54] ALL AROUND PLAYGROUND KIT

[75] Inventor: Victor J. Bertrand, Ile Bizard, Canada

[73] Assignee: The Ritvik Group Inc., Quebec, Canada

[21] Appl. No.: 983,870

[22] PCT Filed: Sep. 6, 1991

[86] PCT No.: PCT/CA91/00331

§ 371 Date: Mar. 23, 1993

§ 102(e) Date: Mar. 23, 1993

[87] PCT Pub. No.: WO92/04091

PCT Pub. Date: Mar. 19, 1992

[30] Foreign Application Priority Data

Sep. 7, 1990 [CA] Canada ..... 2024854

[51] Int. Cl.[6] ..... A63B 9/00

[52] U.S. Cl. ..... 472/117; 472/106

[58] Field of Search ..... 472/106, 108, 111, 114–116, 472/117; 239/289

[56] References Cited

U.S. PATENT DOCUMENTS

| | | | |
|---|---|---|---|
| 756,341 | 4/1904 | Dufty | 472/106 |
| 1,406,765 | 2/1922 | Shackle | 472/106 X |
| 1,545,240 | 7/1925 | Edwards | 472/115 X |
| 1,648,196 | 11/1927 | Rohmer | 472/114 |
| 1,660,737 | 2/1928 | Zeman | 472/106 X |
| 1,752,110 | 3/1930 | Remy | 472/106 |
| 2,616,485 | 11/1952 | Robbins | 472/106 X |
| 2,648,538 | 8/1953 | Robbins | 472/106 X |
| 2,839,299 | 6/1958 | Weiss | 472/116 |
| 3,109,645 | 11/1963 | Thorson | 472/106 |
| 3,110,047 | 11/1963 | Bringman . | |
| 3,246,892 | 4/1966 | Grudoski | 472/116 |
| 3,451,672 | 6/1969 | Hancovsky | 472/114 |
| 3,539,181 | 11/1970 | Larsen | 239/239 X |
| 4,199,138 | 4/1980 | Kaiser | 472/116 X |
| 4,484,739 | 11/1984 | Kreinbihl | 472/117 X |
| 4,805,898 | 2/1989 | Jacober | 472/117 |
| 4,932,648 | 6/1990 | Ahrens | 472/116 |

FOREIGN PATENT DOCUMENTS

| | | | |
|---|---|---|---|
| 1337048 | 7/1963 | France | 472/116 |
| 2118446 | 2/1983 | United Kingdom | 472/106 |
| 2221848 | 2/1990 | United Kingdom | 472/106 |

OTHER PUBLICATIONS

British Patent Specification 1488653.

Popular Mechanics, vol. 111, No. 6, Jun. 1959, p. 108.

*Primary Examiner*—Carl D. Friedman

*Assistant Examiner*—Beth A. Aubrey

*Attorney, Agent, or Firm*—Michael D. Bednarek

[57] ABSTRACT

There is disclosed a play kit of detachable plastic components capable of forming either a slide assembly or a teeter assembly. The kit includes an elongated plastic playboard as a basic playing element. The latter has a wavy configuration and is preferables constructed in two symmetrical members abutting one another and releasably locked to each other. When used as a slide, the playboard is removably connected, at one end, to an upper end of a plastic support formed with steps to act as a ladder. The latter and the playboard are held together by removable struts. When the basic element is used as a teeter board, the support is made to act as a base. A prop structure is then detachably connected to the said base and to the playboard to allow the latter to teeter as well as to rotate about a vertical axis.

16 Claims, 8 Drawing Sheets

Fig. 9
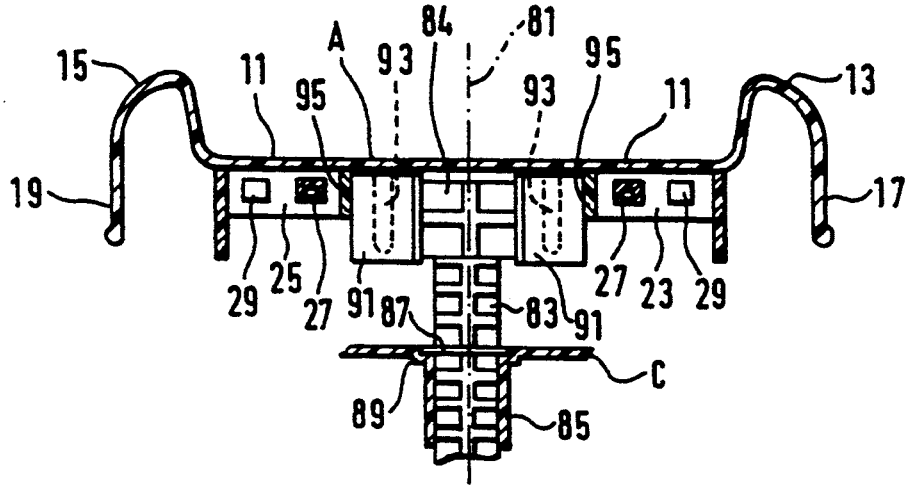
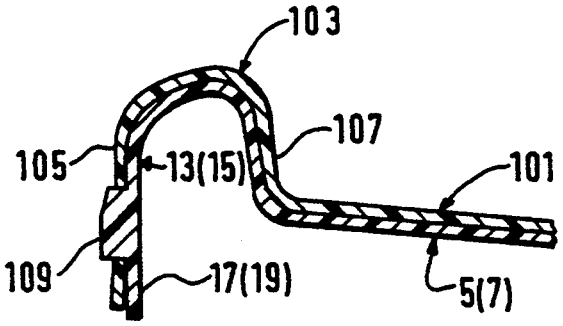
Fig. 12

Fig. 11
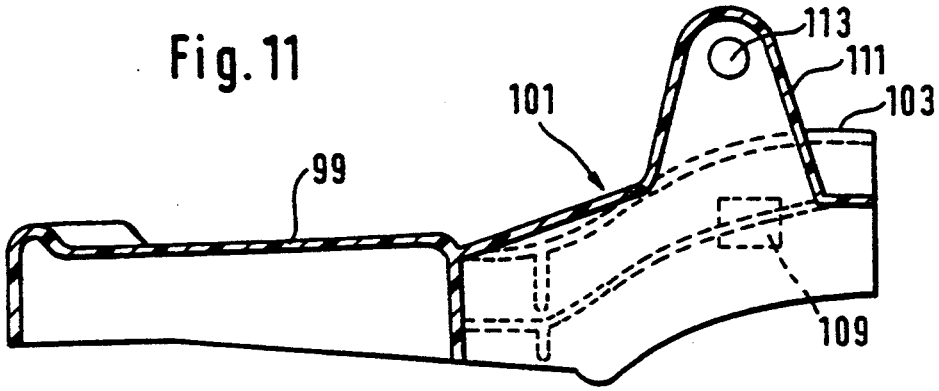
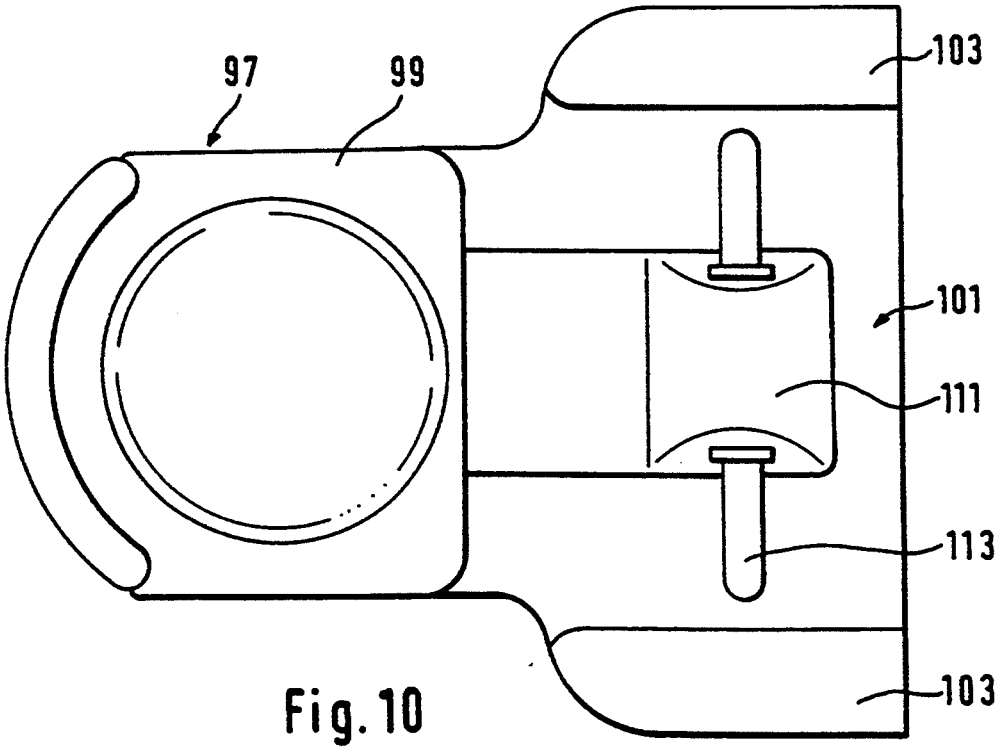
Fig. 10

ALL AROUND PLAYGROUND KIT

FIELD OF THE INVENTION

The present invention relates to a play kit made of detachable plastic components capable of forming either a lounge chain, a slide assembly, a merry-go-round assembly or a teeter assembly, using an elongated plastic playboard as a basic element.

DESCRIPTION OF THE PRIOR ART

Play kits made of detachable components that can be put together to form different assemblies are already know (see U.S. Pat. Nos. 2,839,299; 3,109,645; 3,110,047;3,451,672). However, non of these know play kits is really versatile and have components that can be put together to form a lounge chain, a slide assembly, a merry-go-round assembly or a teeter assembly.

British patent No. 1.488.653 discloses a play kit made of detachable components that may be put together to form a slide assembly, a merry-go-round assembly or a teeter assembly. This kit is interesting but rather cumbersome in size and use to assemble it.

SUMMARY OF THE INVENTION

It is a primary object of the invention to provide a play kit especially, although not exclusively, intended for children or young people and of which selected components may be made into a playboard, which can be used alone as a rocking lounge chair or which can be associated with other components of the kit to form a slide assembly. By another selection of the components, the playboard may be built into a teeter assembly and a merry-go-round assembly.

Another object of the invention is to provide a kit of which the components are all made of plastic material and built so that they can rapidly be assembled and dismounted. In dismounted form, the components can be stored in a relatively small space.

In accordance with the invention, there is provided a play kit comprising:

a) an elongated playboard having a longitudinal axis lying in a flat plane, said playboard being shaped as a slide having a central flat part and two side protection ramps extending lengthwise of and on the lateral edges of said central flat part, said central flat part and ramps being symmetrical with respect to said longitudinal axis;

b) releasable playboard attachment means on at least one of said playboard end portions;

c) a support having releasable support attachment means at one end thereof for releasably coupling with said playboard attachment means in order to hold said playboard in upright position and make it useful as a slide, said support comprising footsteps in order for said support to act as a ladder for said slide; and d) means for dismountably joining said playboard at mid-length thereof to a base lying on the ground, said joining means being constructed to allow said playboard to teeter about at least one central axis normal to said longitudinal axis, characterized in that:

e) said playboard is made of plastic material and has, in the lengthwise direction, a wavy configuration made up of two short end portions of equal length, interconnected by a central curved portion of greater extent, said end portions and central portion gradually merging one into the other, said playboard being symmetrical with respect to a central transverse plane normal to said longitudinal axis and flat plane;

f) two of said releasable playboard attachment means are provided for, one on each of said playboard end portions, said two playboard attachment means being identical with one another and symmetrical with respect to said longitudinal axis and transverse plane;

g) said support is made of plastic material and is molded with said footsteps;

h) plastic strut means are provided for, said strut means being releasable connectable at the end thereof to said playboard and said support in order to prevent them from unfolding when they are used as a slide and ladder;

i) said support also forms said base to which said playboard may be joined to allow said playboard to teeter, and j) a pair of plastic seat constructions is provided for, each construction being dismountably fixable to one of said end portions of said playboard to make the same useful as a teeter assembly when it is joined to said support by said joining means.

A non restrictive description will now be given of a preferred embodiment of the invention having reference to the appended drawings.

BRIEF DESCRIPTION OF THE DRAWINGS

FIG. 9 is a partial transverse cross section of the teeter assembly of FIG. 7;

FIG. 10 is a top plan view of a seat construction for use with the teeter assembly;

FIG. 11 is a longitudinal cross section of the seat assembly of FIG. 10, and FIG. 12 is a cross sectional view of a detail of the seat assembly.

DESCRIPTION OF THE PREFERRED EMBODIMENT

Figure 1:
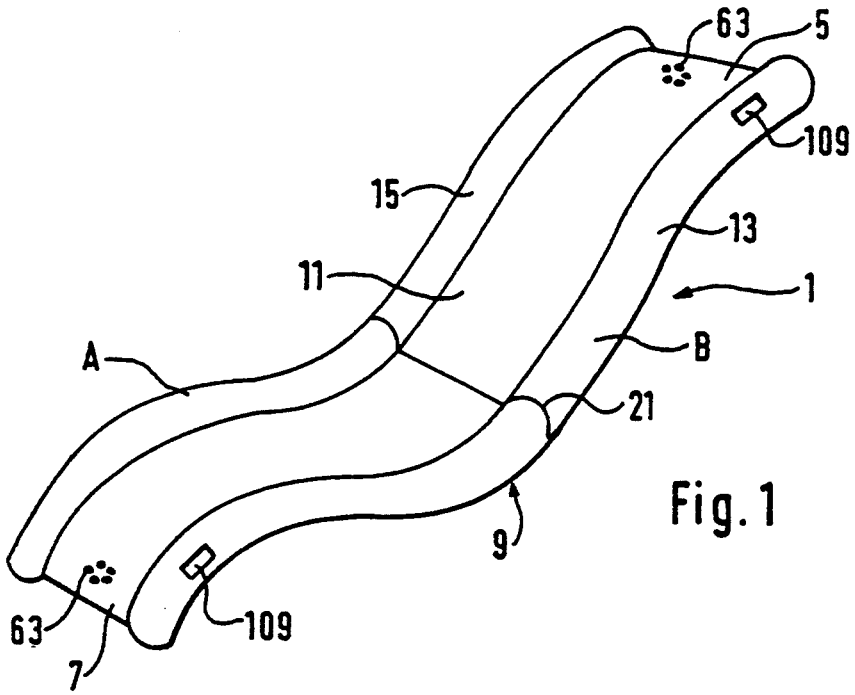
FIG. 1 is a perspective view of a playboard, made according to the teaching of the invention.
Figure 7:
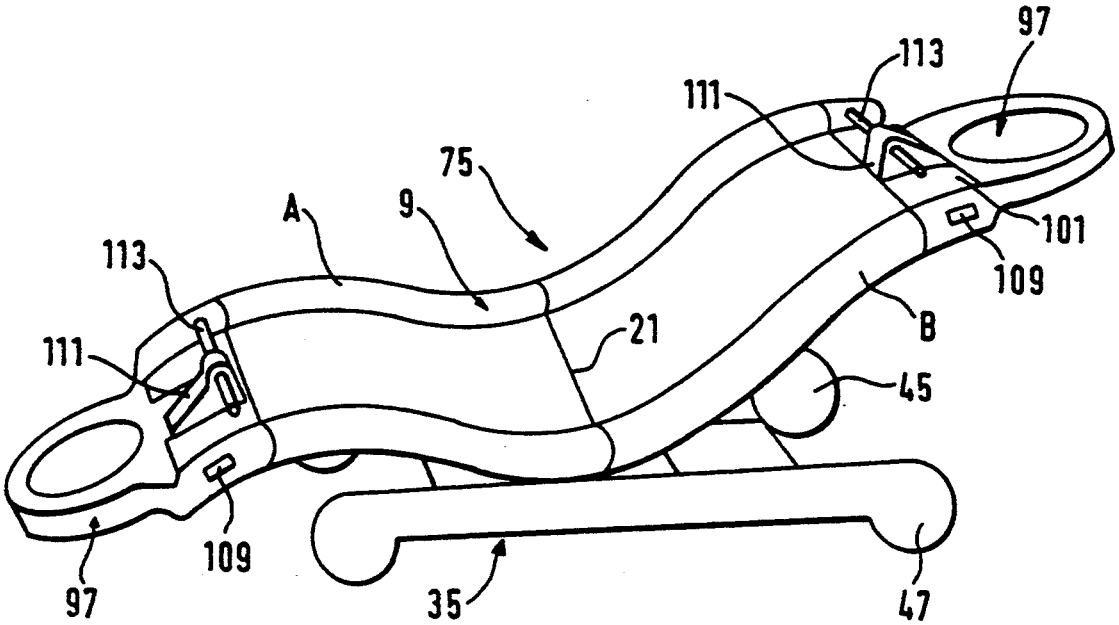
FIG. 7, first sheet of drawings, is a perspective view of a teeter assembly.

Referring to the drawings, there is shown an elongated playboard 1 made of sturdy plastic material and having a longitudinal axis 3 (FIG. 4) lying in a flat plane, i.e. a playboard which is straight when viewed from above. It has, seen sideways and in the lengthwise direction, a wavy configuration made up of two short end portions 5, 7, of equal length interconnected by an intermediate curved portion 9 of greater extent; the end and central portions gradually merging one into the other, as shown. The end portions 5, 7, are straight but may also be slightly curved. As can be gathered, the playboard may be used alone as a rocking lounge-chair.

Figure 2:
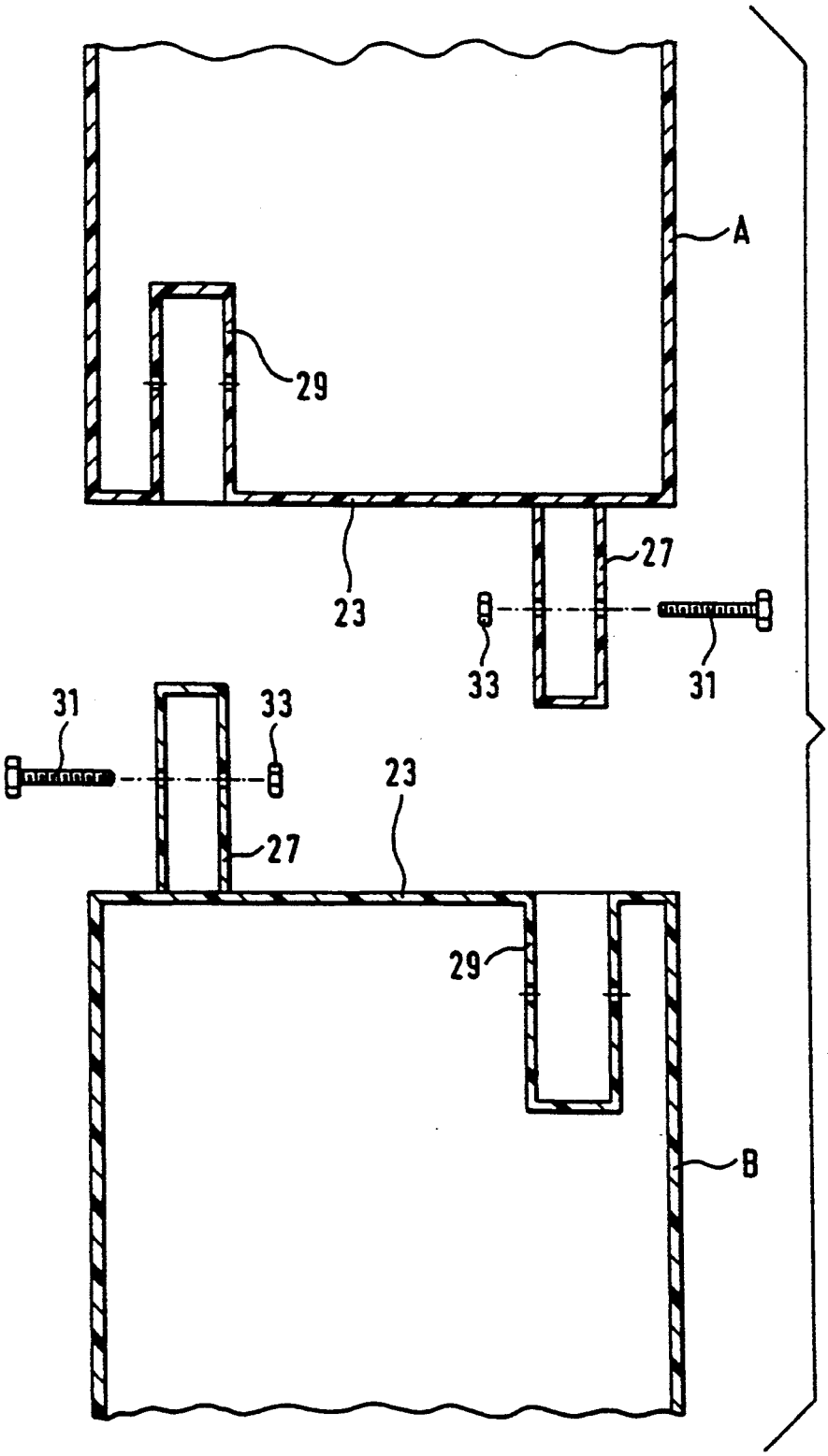
FIG. 2 is an exploded view, in cross section, showing the coupling means for joining the two identical and separate members that make up the playboard of FIG. 1.

The playboard 1 is also shaped like a slide in that it has a central flat part 11 and two parallel side protection ramps 13, 15, running the full length of the playboard 1 along the lateral edges of the central part 11; the latter and the ramps 13, 15 being symmetrical with respect to the longitudinal axis 3. Each protection ramp 13, 15, includes an outward lateral flange 17, 19, (FIG. 9) which is slightly resilient due to the nature of the plastic material and for a purpose to be determined hereinafter. Additionally, the playboard is preferably constructed in two identical and separate members A and B that are symmetrical with one another relative to a transverse plane (containing boundary line 21 in FIGS. 1, 3, 5, 7, 8) normal to the longitudinal axis 3 as well as to the longitudinal flat plane aforesaid. These members A and B are in end abutment one against the other in the transverse plane which contains the boundary line 21 and, for this purpose, are each formed with a pair of coplanar transverse webs 23, 25, as shown in FIG. 9. Means shown in FIG. 2 are used to join the two symmetrical members together. These means comprise tubular male and female coupling elements 27, 29, cooperating in pairs at the abutting ends to lock the members A, B, together; the male elements 27 once inserted into the female elements 29 being connected thereto by means of bolts and nuts 31, 33. As illustrated in FIG. 9, the male elements 27 are on the inward side of the playboard member A and the female elements are on the outward side. The disposition of the elements are reversed on the playboard member B. This arrangement advantageously allows the members A and B to be molded in one and the same mold.

Figure 3:
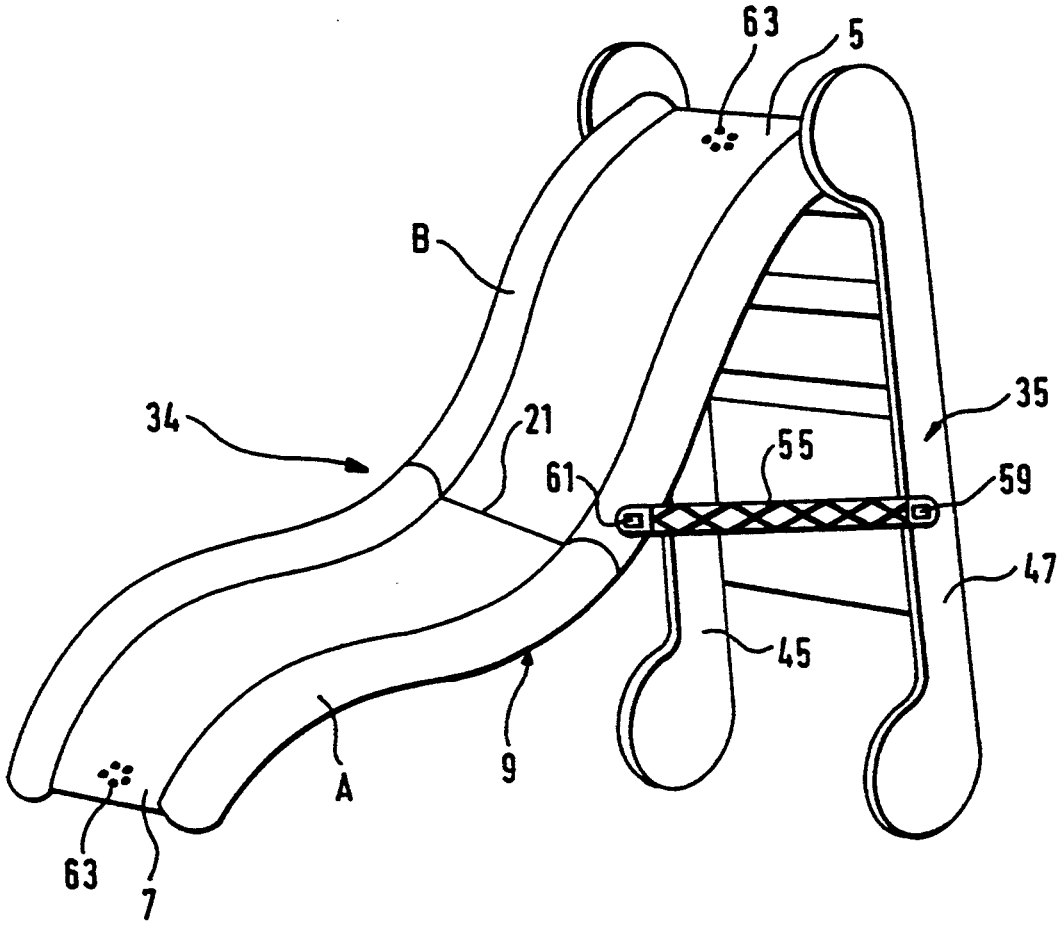
FIG. 3 is a perspective view of a slide assembly.
Figure 4:
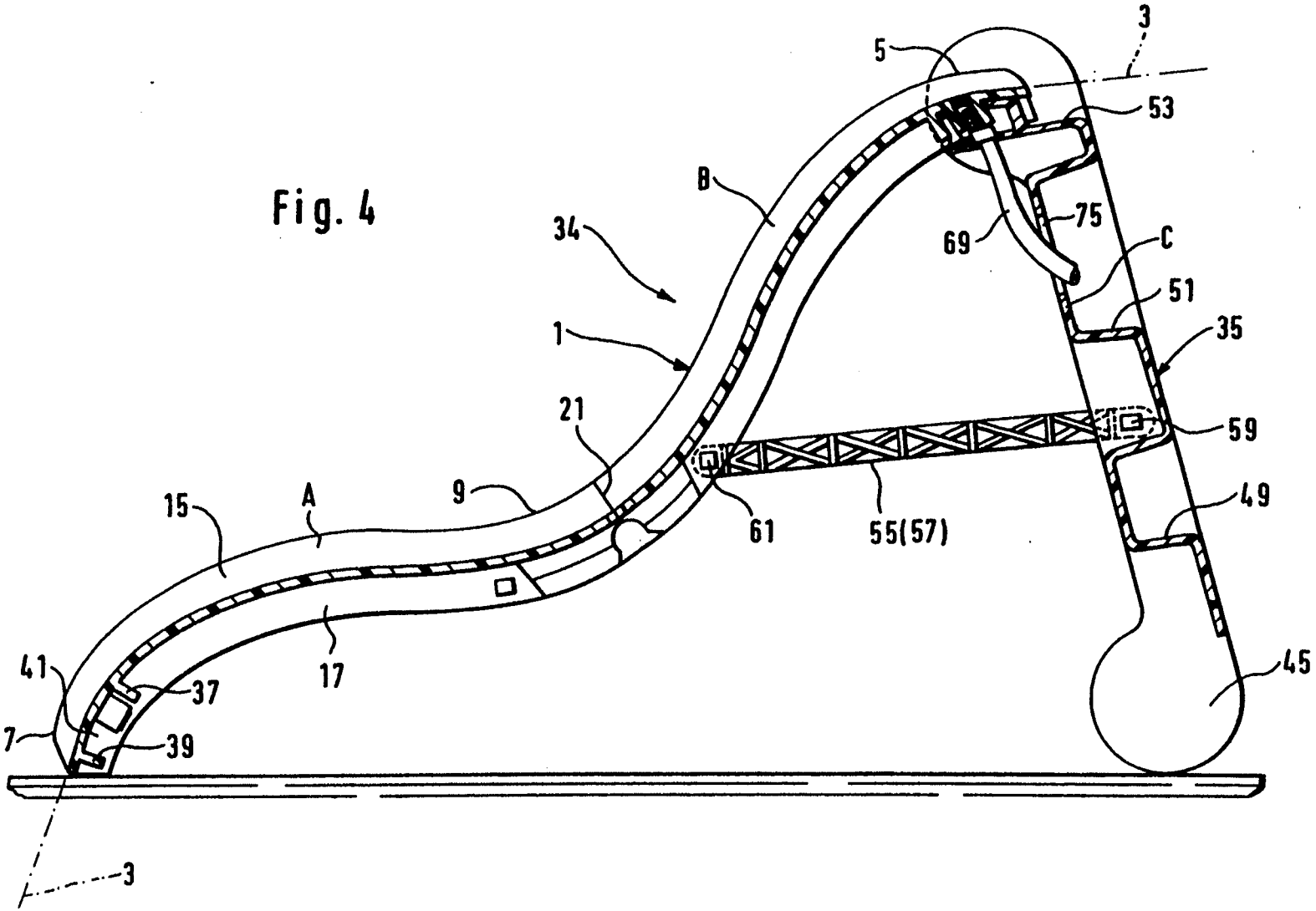
FIG. 4 is a longitudinal cross sectional view of the slide assembly in FIG. 3.

FIGS. 3 and 4 show the playboard 1 when used as a slide 34, in which case the playboard 1 is dismountably held in upright position by a plastic support 35; the latter and the playboard 1 being provided, for that purpose, with suitable attachment means that are releasable.

Figure 5:
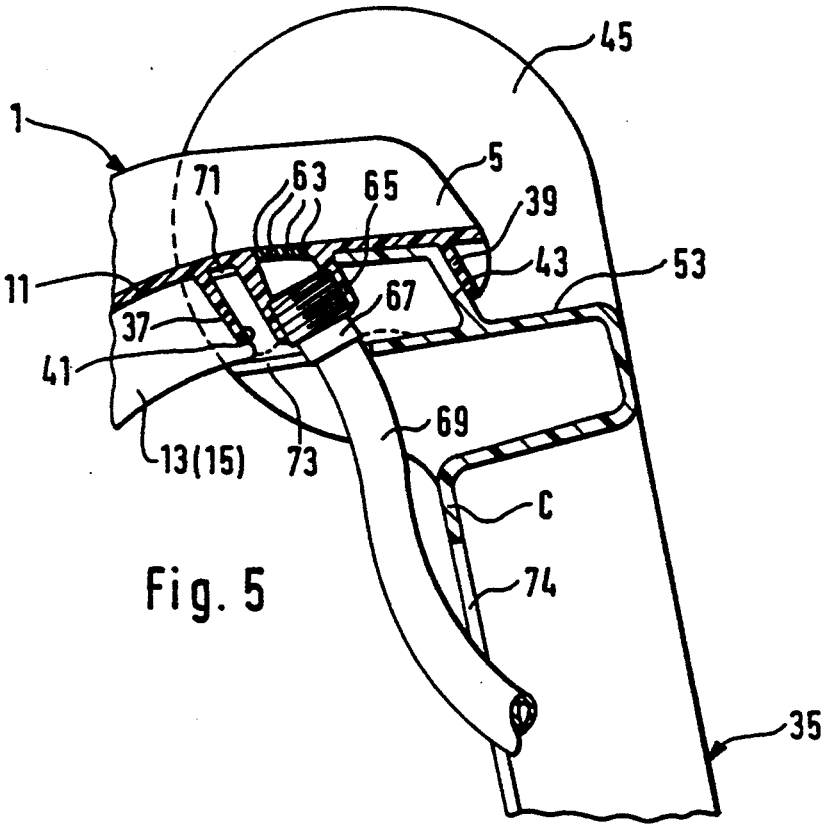
FIG. 5 is a cross section, on an enlarged scale, of the upper end of the slide assembly in FIG. 3.

Such means, in the case of the playboard, are provided at each end portion 5, 7; are identical with one another and are symmetrical with respect to the longitudinal and transverse flat planes, mentioned above. Referring to FIG. 5, the playboard attachment means, at each end portion of the playboard 1, comprise a pair of transverse cheeks 37, 39, depending on the playboard central portion 11, which cheeks cooperate with parts of the adjacent ramps 13, 15, to define a lock keeper 41. The attachment means of the support 35, on the other hand, comprise a hollow lock bolt 43 which, as shown, is shaped and sized to fit snugly and releasably into the lock keeper 41. The latter and the bolt 43 are parallelepipedic in cross section, although they may alternatively be rectangular. In this manner, the support 35 may be coupled with either one of the playboard end portions 5, 7, simply by slidably fitting its bolt 43 into the desired one of the playboard keepers 41.

Figure 6:
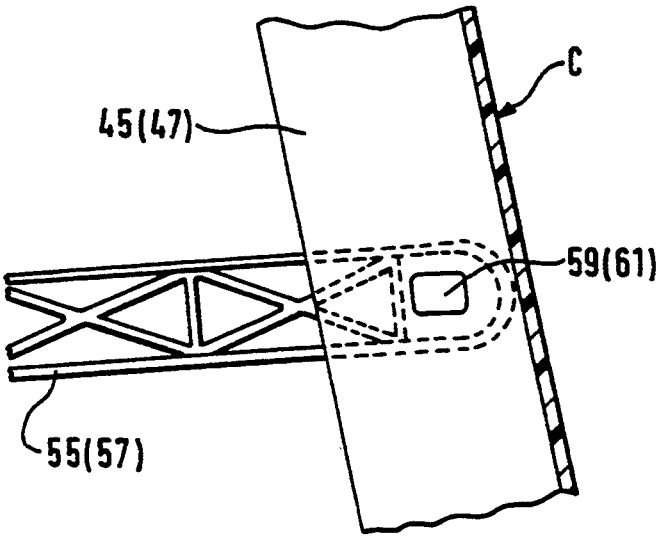
FIG. 6 is a cross section, on an enlarged scale, of the connection between the playboard and the slide support.

FIGS. 3 and 4 show the plastic support 35 to be made of a pair of essentially flat outer flanges 45, 47, interconnected by a broken web C defining a bottom step 49, a central step 51 and a top step 53, equally spaced from one another. The ends of the flanges 45, 47, are rounded and bulge away from the web C in the direction of the playboard 1. The playboard 1 and the support 35 are kept from collapsing by means of a pair of elongated parallel latticed struts 55, 57 (FIGS. 3, 4, 6), molded of plastic material and provided on either side of the playboard and of the support. These struts have, at their ends, locking lugs 59, 61, projecting in the direction of the playboard and of the support. The lugs 59, 61 are sized and shaped to fit snugly into suitable apertures, through the flanges 17, 19, 45, 47, respectively, of the playboard 1 and of the support 35, so as to be pressed fitted into the apertures. The struts are freed simply by finger-pushing the lugs out of the apertures.

Adding to the fun of using the playboard 1 as a slide assembly, are water sprinkling holes 63 provided through each end portion 7. As shown in FIG. 5, these holes communicate with a water-connector 65 of which the bore is threaded for receiving the end nozzle 67 of a water hose 69. In the arrangement of FIG. 5, the connector 65 extends into the lock keeper 41 and, for this purpose, the top and bottom of the hollow lock bolt 43 are slitted at 71, 73. The sprinkler holes 63 and the water connector 65 may of course be provided outside the keeper 41. A hole 75 is provided at the bottom of the web C for the passage of the hose 69.

Figure 8:
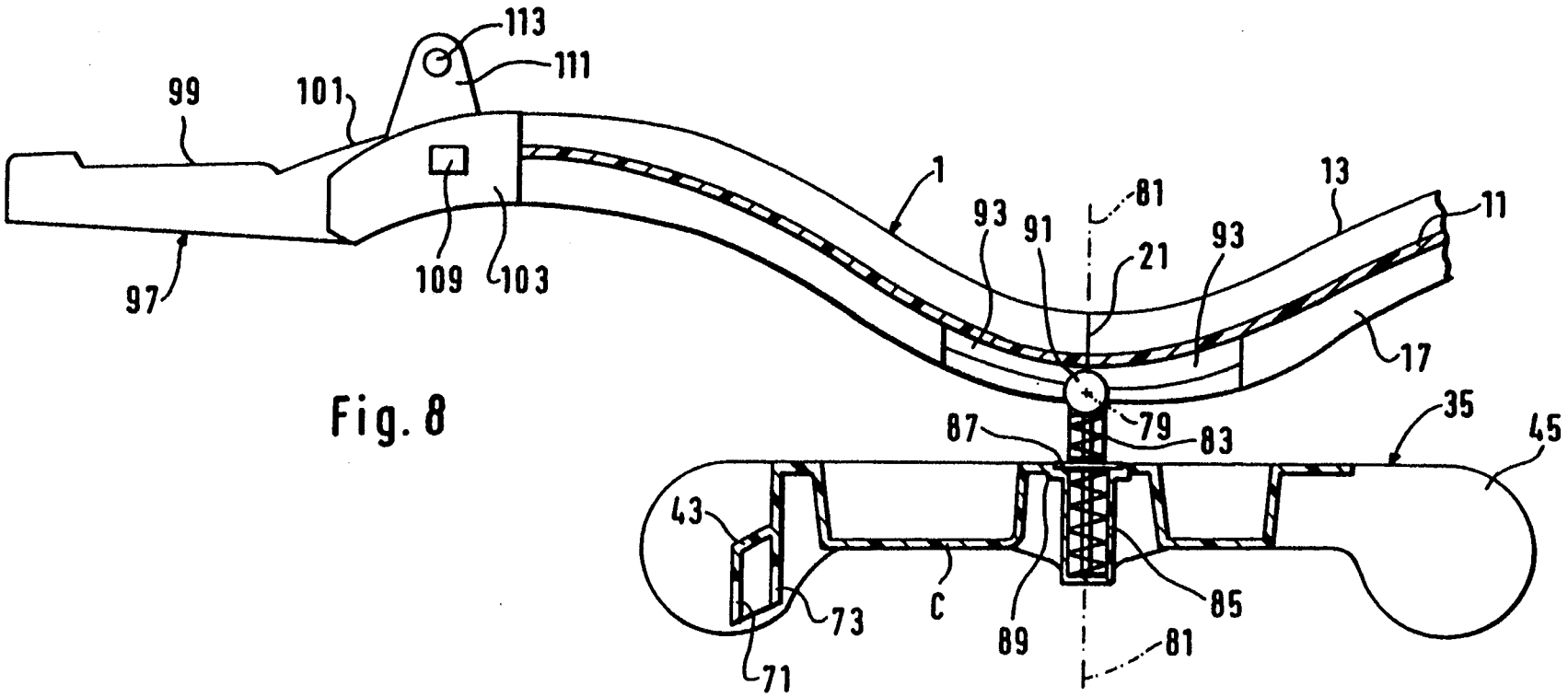
FIG. 8 is a longitudinal cross sectional view of the teeter assembly of FIG. 7.

As mentioned before, the playboard 1 and the support 35 may be used as a teeter assembly 75 as in FIGS. 7 through 12. In that case, the support 35 lies flatly on the ground. FIGS. 8 and 9 illustrate means allowing the playboard 1 to be dismountably joined with the support 35 and constructed to allow the playboard to teeter about a horizontal axis 79 lying in the transverse plane 21 as well as to rotate about a vertical axis 81 at the center of the support 35. Accordingly, a central outwardly ribbed cylindrical post 83 has one end removably slid into the bore of a bearing sleeve 85. The post has a shoulder 87 which rests in an annular seat 89 formed, along with the sleeve 85, at the center of the broken web C of the support 35; the shoulder and seat acting as a trust bearing. A pair of rollers 91 is mounted on and diametrically across the free end of the post 83, on a transverse bar 84 thereof, for rotation about the teeter horizontal axis 79. The playboard 1 is guided during teetering by a pair of first accurate ribs 93, each defining a half circular seat for straddling the rollers 91, and by a pair second ribs 95 that extend laterally of the rollers to prevent lateral swaying motion of the playboard; both ribs 93, 95 depending from the central part 11 of the playboard 1.

For use as a teeter board, the playboard 1 is provided with a pair of special seat constructions 97, each of which is dismountably fixed to one of the end portions 5, 7. Each construction comprises a generally flat seat 99 and, solid with it, a mounting part 101 projecting radially from the seat. Part 101 has, on each side, an inverted U-shaped saddle 103 (FIG. 12) defining parallel lateral flanges 105, 107. The saddles 103 are sized and shaped for snugly fitting over the ramps 13, 15, formed at the corresponding end portions 5, 7 of the playboard. As shown in FIG. 12, each saddle 103 has its outward flange 105 overlapping the outward flange 17 of a relevant ramp 13. In order to hold the seat 99 fast in mounted position but removably from the playboard 1, the outward flanges 17, 19 of each ramp are provided with outwardly projecting ears 109 that are snap-fitted into suitable apertures of the flanges 105 of the saddles 103 (FIG. 12). To ease in removing the seat construction, the lower edges of the saddle flanges 105 are made to move away from the lower edges of the ramp flanges 17 for prying the saddle flanges loose from the ears 109.

The central portion of each seat mounting part 101 is formed with a bridge 111 holding a handle bar 113.

I claim:

1. A play kit comprising:

an elongated playboard (1) having a longitudinal axis (3) lying a flat plane, and two end portions (5,7), said playboard (1) being shaped as a slide having a central flat part (11) and two side protection ramps (13, 15) extending lengthwise of and on the lateral edges of said central flat part, said central flat part (11) and ramps (13,15) being symmetrical with respect to said longitudinal axis;

two releasable playboard attachment means (41), comprising one attachment means provided on each of said two playboard end portions (5, 7);

a support (35) having releasable support attachment means at one end thereof for releasably coupling with said playboard attachment means (41) in order to hold said playboard (1) in upright position and make it useful as a slide (FIGS. 3 and 4), said support (35) comprising footsteps (49, 51, 53) in order for said support to act as a ladder for said slide; and means (83, 84, 91) for dismountably joining said playboard at mid-length thereof to a base lying on the ground, said joining means being constructed to allow said playboard to teeter (see FIG. 8) about at least one central axis (79) normal to said longitudinal axis (3), wherein said playboard (1) is made of plastic material and has, in the lengthwise direction, a wavy configuration made up of two short end portions (5, 7) of equal length, interconnected by a central curved portion (9), said end portions and central portion gradually merging one into the other, said playboard (1) being symmetrical with respect to a central transverse plane (21) normal to said longitudinal axis (3) and flat plane;

said two playboard attachment means (41) are identical with one another and symmetrical with respect to said longitudinal axis and transverse plane (21);

said support (35) is made of plastic material and is molded with said footsteps (49, 51, 53) and said support (35) also forms said base to which said playboard (1) may be joined to allow said playboard to teeter, and further comprising:

plastic strut means, said strut means being releasably connectable at the end thereof to said playboard (1) and said support (35) in order to prevent said playboard and support from unfolding when they are used as a slide and ladder;

a pair of plastic seat constructions (97), each plastic seat construction being dismountably fixable to one of said end portions (5, 7) of said playboard (1) to make the same useful as a teeter assembly (FIG. 8) when it is joined to said support (35) by said joining means (83, 84, 91) and identical water sprinkler means (63, 65) at each of said playboard end portions (5, 7), symmetrically disposed with respect to said transverse plane (21) the water sprinkler (63, 65) means comprising, at each end of said playboard;

means defining a water connector (65) beneath said central flat part (11) of said slide-shaped playboard, said connector being threaded at one end for connection with a water hose (69); and said central flat part being formed with sprinkler holes (63) in communication with said connector (65).

2. A play kit comprising:

an elongated playboard (1) having a longitudinal axis (3) lying in a flat plane and two end portions (5,7), said playboard (1) being shaped as a slide having a central flat part (11) and two side protection ramps (13, 15) extending lengthwise of and on the lateral edges of said central flat part, said central flat part (11) and ramps (13,15) being symmetrical with respect to said longitudinal axis;

two releasable playboard attachment means (41), comprising one attachment means provided on each of said two playboard end portions (5, 7);

a support (35) having releasable support attachment means at one end thereof for releasably coupling with said playboard attachment means (41) in order to hold said playboard (1) in upright position and make it useful as a slide (FIGS. 3 and 4), said support (35) comprising footsteps (49, 51, 53) in order for said support to act as a ladder for said slide; and means (83, 84, 91) for dismountably joining said playboard at mid-length thereof to a base lying on the ground, said joining means being constructed to allow said playboard to teeter (see FIG. 8) about at least one central axis (79) normal to said longitudinal axis (3), wherein said playboard (1) is made of plastic material and has, in the lengthwise direction, a wavy configuration made up of two short end portions (5, 7) of equal length, interconnected by a central curved portion (9), said end portions and central portion gradually merging one into the other, said playboard (1) being symmetrical with respect to a central transverse plane (21) normal to said longitudinal axis (3) and flat plane;

said two playboard attachment means (41) are identical with one another and symmetrical with respect to said longitudinal axis and transverse plane (21);

said support (35) is made of plastic material and is molded with said footsteps (49, 51, 53) and said support (35) also forms said base to which said playboard (1) may be joined to allow said playboard to teeter, and further comprising:

plastic strut means, said strut means being releasably connectable at the end thereof to said playboard (1) and said support (35) in order to prevent said playboard and support from unfolding when they are used as a slide and ladder;

a pair of plastic seat constructions (97), each plastic seat construction being dismountably fixable to one of said end portions (5, 7) of said playboard (1) to make the same useful as a teeter assembly (FIG. 8) when it is joined to said support (35) by said joining means (83, 84, 91 said playboard attachment means (41) comprise, at each end portion of said playboard (1), means (37, 39) defining a locking keeper beneath said playboard central part; and said support attachment means (43) comprise, at one end of said support (35), a locking bolt (43) sized and shaped to fit snugly and releasably into a selected one of said locking keepers (41) to hold said playboard (1) in said upright position.

3. A play kit as claimed in claim 1, characterized in that said playboard (1) is constructed of two identical and separate members (A,B) symmetrical with one another relative to said transverse plane (21), said members (A,B) being in end abutment one against the other in said transverse plane, and in that means (27, 29, 31, 33) are provided to join said two symmetrical members (A,B) together in said end abutment to form said wavy configuration.

4. A play kit as claimed in claim 3, characterized in that said means (27, 29, 31, 33) to join said playboard members comprise male and female coupling elements (27, 29) cooperating in pairs at said abutting ends to lock said members together, said elements being disposed to allow molding of said two members (A,B) in one and the same mold.

5. A play kit as claimed in any one of claims 3 to 4 characterized in that it further comprises identical water sprinkler means (63, 65) at each of said playboard end portions (5, 7), symmetrically disposed with respect to said transverse plane (21).

6. A play kit as claimed in claim 1, characterized in that said playboard ramps (13, 15) and said support (35) define outward lateral flanges (17, 19, 45, 47) formed with locking apertures between the ends of said playboard (1) and the ends of said support (35), and said strut means (55, 57) comprise:

a pair of elongated plastic struts (55, 57) each on one side of said playboard (1) and on one side of said support (35);

locking lugs (59, 61) projecting laterally from the ends of said struts (55, 57) in the direction of said playboard (1) and entering said apertures; and wherein said lugs (59, 61) are sized and shaped to fit snugly into said apertures whereby to be press-fitted removably therein.

7. A play kit as claimed in claim 6, characterized in that:

said playboard attachment means (41) comprise, at each end portion of said playboard (1), means (37, 39) defining a locking keeper beneath said playboard central part; and said support attachment means (43) comprise, at one end of said support (35), a locking bolt sized and shaped to fit snugly and releasably into a selected one of said locking keepers (41) to hold said playboard (1) in said upright position.

8. A play kit as claimed in claim 7, characterized in that it further comprises identical water sprinkler means (63, 65) at each of said playboard end portions, symmetrically disposed with respect to said transverse plane (21), and in that said water sprinkler means (63, 65) comprise, at each end of said playboard:

means defining a water connector (65) beneath said central flat part (11) of said slide defining playboard, said connector (65) being threaded at one end for connection with a water hose (69); and said central part being formed with sprinkler holes (63) communicating with said connector (65).

9. A play kit as claimed in claim 2, characterized said joining means (83, 84, 91) include means (85) allowing said playboard (1) to rotate about an axis (81) normal to said teeter axis (79).

10. A play kit as claimed in claim 2, characterized in that said joining means (83, 84, 91) comprise:

a central post (83) projecting from said support (35), and being removable therefrom;

a pair of rollers (91) mounted at the free end of said post (83) and on either side thereof for rotation about said teether axis (79); and means (93, 95) on said playboard (1) removably fitting over said rollers (91) and guiding said playboard during teetering thereof.

11. A play kit as claimed in claim 10, characterized in that said fitting means (93, 95) comprise:

first ribs (93) projecting from said central part of said playboard and straddling said rollers (91); and second ribs (95) projecting from said central part parallel to said first ribs (93), said second ribs extending laterally of said rollers (91) to prevent lateral swaying motion of said playboard (1) during teetering thereof.

12. A play kit as claimed in claim 11, characterized in that said joining means (83, 84, 91) also comprise means (85) allowing said playboard (1) to rotate about an axis normal (81) to said teeter axis (79).

13. A play kit as claimed in claim 12, characterized in that said central post (83) is cylindrical and said playboard rotation means comprise:

trust bearing means (85, 89) on said support (35), into which is removably received the other end of said post (83) for rotation of said post about said rotation axis (81) normal to said teeter axis (79).

14. A play kit as claimed in claim 10, characterized in that said playboard ramps (13, 15) define outward lateral flanges (17, 19), each flange having an outwardly projecting locking ear (109) at said playboard end portions (5, 7), and wherein each of said seat constructions (97) comprises:

an essentially flat seat (99);

a playboard mounting part (101) solid with and projecting from said seat (99), said part (101) having lateral saddles (103) sized and shaped for snugly fitting over said ramps (13, 15) at corresponding ones of said playboard end portions; and wherein said saddles (103) have outward flanges (105, 107) overlapping said outward flanges (17, 19) of said ramps (13, 15) and are formed with locking apertures into which said locking ears (109) snappingly fit.

15. A play kit as claimed in claim 14, characterized in that said joining means (83, 84, 91) include means (85) allowing said playboard (1) to rotate about an axis normal (81) to said teeter axis (79).

16. A play kit as claimed in claim 15, characterized in that said joining means (83, 84, 91) comprise:

a central post (83) projecting from said support (35), and being removable therefrom;

a pair of rollers (91) mounted at the free end of said post (83) and on either side thereof for rotation about said teeter axis (79); and means (93, 95) on said playboard (1) removably fitting over said rollers (91) and guiding said playboard during teetering thereof.

* * * * *

UNITED STATES PATENT AND TRADEMARK OFFICE

CERTIFICATE OF CORRECTION

PATENT NO. : 5,387,158
DATED : February 7, 1995
INVENTOR(S) : Victor J. Bertrand It is certified that error appears in the above-indentified patent and that said Letters Patent is hereby corrected as shown below:

Title page, item [57] col. 2,

IN THE ABSTRACT

Line 5, change "preferables" into --preferably--.

Column 1, line 14, change "know" into --known--;

line 15, change "non" into --none--;

line 15, change "know" into --known--;

line 17, change "chain" into --chair--.

Column 3, line 6, change "protection" into --projection--;

line 10, change "protection" into --projection--.

Column 5, line 8, change "protection" into --projection--.

UNITED STATES PATENT AND TRADEMARK OFFICE

CERTIFICATE OF CORRECTION

PATENT NO. : 5,387,158
DATED : February 7, 1995
INVENTOR(S) : Victor J. Bertrand It is certified that error appears in the above-indentified patent and that said Letters Patent is hereby corrected as shown below:

Column 8, line 5, change "teether" into --teeter--.

Signed and Sealed this

Fourth Day of June, 1996

Bruce Lehman

*Attest:*

BRUCE LEHMAN

*Attesting Officer*

*Commissioner of Patents and Trademarks*